US005975929A

United States Patent [19]

Matsuura et al.

[11] Patent Number: 5,975,929

[45] Date of Patent: Nov. 2, 1999

[54] SLIDABLY FITTING TYPE CONNECTOR

[75] Inventors: Toshifumi Matsuura; Toshiaki Okabe, both of Shizuoka, Japan

[73] Assignee: Yazaki Corporation, Tokyo, Japan

[21] Appl. No.: 09/105,043

[22] Filed: Jun. 26, 1998

[30] Foreign Application Priority Data

Jun. 27, 1997 [JP] Japan ..... 9-172441

[51] Int. Cl.[6] ..... H01R 13/62

[52] U.S. Cl. ..... 439/157; 439/352; 439/372

[58] Field of Search ..... 439/157, 372, 439/160, 152, 155, 352

[56] References Cited

FOREIGN PATENT DOCUMENTS 6-124747 5/1994 Japan .

6-79080 11/1994 Japan .

*Primary Examiner*—Neil Abrams
*Assistant Examiner*—Javaid Nasri
*Attorney, Agent, or Firm*—Morgan, Lewis & Bockius LLP

[57] ABSTRACT

A slidably fitting type connector has a slide member overlying slidably on a male connector housing and is arranged so that the male connector housing is fitted to and separated from a female connector housing when the leading end portions of each lever engages with a pair of engaging portions of the female connector housing when the slide member is moved back and forth. The levers are provided between the slide member and the male connector housing on inner both sides of the slide member in such a manner that the two levers are directed opposite to each other.

24 Claims, 6 Drawing Sheets

SLIDABLY FITTING TYPE CONNECTOR

BACKGROUND OF THE INVENTION

1. Field of the Invention

This invention relates to a slidably fitting type connector in which a slide member is slidably movable reciprocally in fitting and detaching directions of multi-pole female and male connector housings, both the connector housings are easily fitted to each other and detached from each other due to the leverages of two levers which are pivoted by sliding the slide member with a small operation force.

The present application is based on Japanese Patent Application No. Hei. 9-172441, which is incorporated herein by reference.

2. Description of the Related Art

FIGS. 6A and 6B show an example of a lever type connector 1 which utilizes leverage. The lever type connector 1 includes a multi-pole female connector housing 2. A slide groove 4 is formed in the frame supporting portion 3 of the female connector housing 2. A slide shaft 6 projects from one lower end side of a frame-shaped lever 5, and is slidably supported in the slide groove 4. Further, a pair of male connector housings 7 and 7 that are fittable to and detachable from the female connector housing 2 are pivotally supported by a shaft 8 within the frame-shaped lever 5.

Both connector housings 2 and 7 are fitted to and detached from each other by vertically moving a lever operating portion 9 that projects from the other upper end side of the lever 5 so that the lever 5 pivots with the slide shaft 6 as a fulcrum. Incidentally, the technique similar to the lever type connector 1 is disclosed in Unexamined Japanese Utility Model Publication No. Hei. 6-79080 and so forth.

In the above-mentioned conventional lever type connector 1, however, when the male connector housings 7 are fitted into the female connector housing 2 in a narrow mounting space or the like where the female connector housing 2 can not be seen, for example, a person is required to grope for positioning the slide shaft 6 serving as a fulcrum of the lever 5 at the slide groove 4 of the frame supporting portion 3 of the female connector housing 2 and to insert into and engage with the slide groove 4. Such an operation requires skilled operation and so the fitting operation of the male and female connector housings 2, 7 may be troublesome. Furthermore, since the slide shaft 6 and the lever operating portion 9 are protruded at the both sides of the lever 5 supporting the male connector housings 7, the entire size of the lever type connector 1 becomes large. Furthermore, due to the external load force or the like, the slide shaft 6 of the lever 5 may come out of the slide groove 4 of the frame supporting portion 3, and the slide shaft 6 and the lever operating portion 9 protruded at the both sides of the lever 5 may be broken.

SUMMARY OF THE INVENTION

An object of the present invention is to eliminate the above-mentioned drawbacks accompanying the conventional lever type connector.

More specifically, an object of the present invention is to provide a slidably fitting type connector with excellent operability wherein both connector housings can be fitted to each other and detached from each other easily and stably by only sliding a slide member with small operating force in the fitting and detaching directions due to the leverages of two levers contained in both sides of the slide member.

According to tho first aspect of the present invention, there is provided a slidably fitting type connector which comprises:

a first connector housing having first and second engaging portions formed therein;

a second connector housing fittable to the first connector housing, the second connector housing having two point-of-action portions formed thereon;

a slide member slidably movable on the second connector housing reciprocally in fitted and detached directions of the second connector housing to and from the first connector housing, the slide member having two support shafts;

two levers each including:

a base portion being pivotably supported by one of the support shafts, wherein the levers respectively pivot as the slide member is slid on the second connector housing, a mid-portion engaged with one of the point-of-action portions of the second connector housing, and a leading end portion engageable with and disengageable from the first and second engaging portions of the first connector housing when the first and second connector housings are fitted to each other and detached from each other, wherein when the slide member is moved in the fitting direction of the Second connector housing, the leading end portions engage with the respective first engaging portions so that the first and second connector housings are pulled to each other, and when the slide member is moved in the detaching direction of the second connector housing, the leading end portions engage with the respective second engaging portions so that the first and second connector housings aro pulled apart from each other, and wherein the levers are provided on both sides of the slide member between the slide member and the second connector housing, and the levers can be diagonally opposed to each other.

In the slidably fitting type connector, the fitting and detaching operation between the first and second connector housings can be performed easily by merely sliding the slide member in the fitted and detached directions of the second connector housing. At this time, the first and second connector housings are stably and surely fitted to and detached from each other due to the leverages of the two lever by sliding the slide with a small operating force. Since the two levers are contained in the slide member so as not to project outside, the levers and the like are never damaged by external load force as the conventional lever type connector. Thus, the function of leverages of the two levers is prevented from being hampered to ensure that the both connector housings are smoothly fitted to each other and separated from each other in a stable condition always.

According to the second aspect of the present invention, a distance from the base portion of each lever to the mid-portion of the lever coupled to the point-of-action portions of the second connector housing is met longer than a distance from the mid-portion to the leading end portion of the lever.

Balance of forces acting on the respective point-of-action portions of the second connector housing when both connector housings are fitted to each other and separated from each other is stabilized by the two levers, so that both connector housings are effectively fitted to each other and separated from each other by sliding the slide member with smaller operating force.

DETAILED DESCRIPTION OF THE PREFERRED EMBODIMENT

An embodiment of the present invention will now be described with reference to FIGS. 1–5C.

Figure 1:
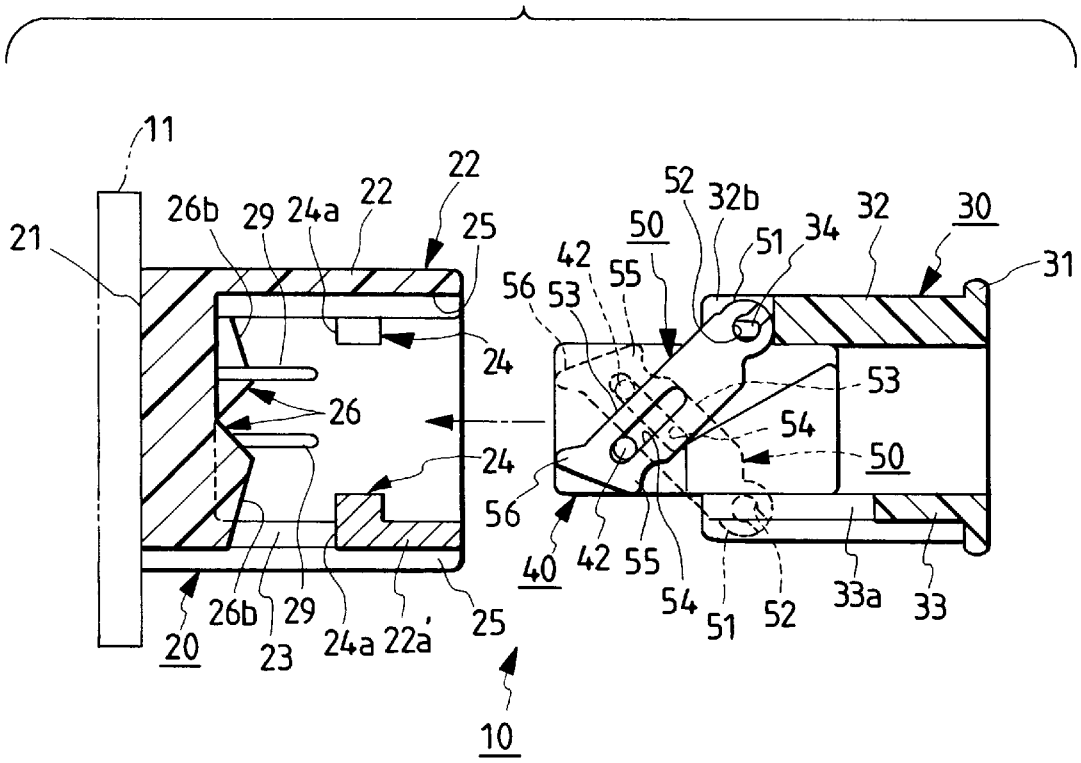
FIG. 1 is a sectional view showing a condition before the housings of a slidably fitting type connector of a preferred embodiment of the present invention are fitted to each other.
Figure 2:
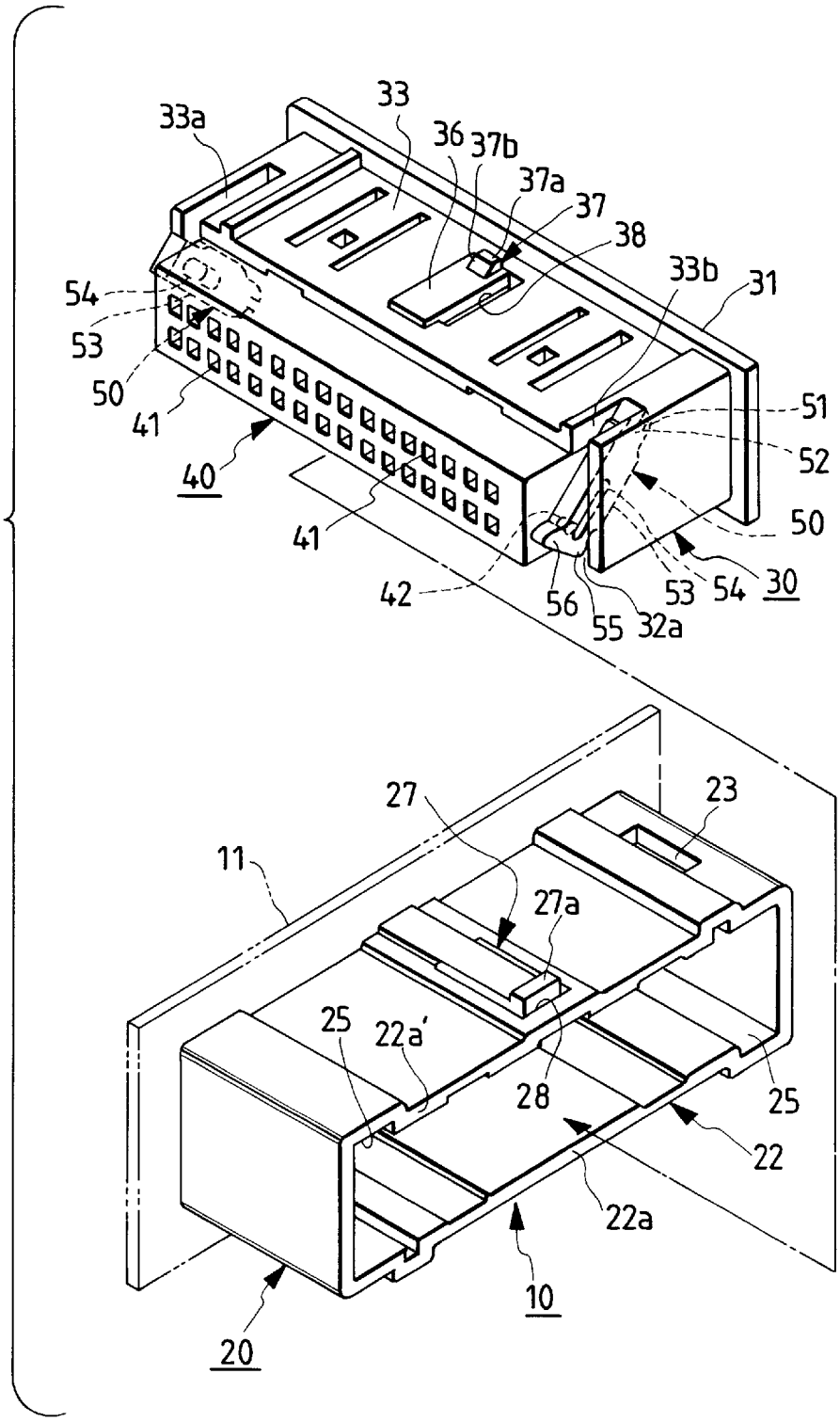
FIG. 2 is a perspective view of a female connector housing together a male connector housing as seen from the bottom side before both housings are fitted to each other.

As shown in FIGS. 1 and 2, a slidably fitting type connector 10 comprises: a female connector housing 20 made of synthetic resin, the female connector housing 20 including a plurality of male terminals 29 projecting from a back wall 21 of a hood portion 22 which is formed in a square-tube like manner, the back side of the back wall 21 being secured to a base board 11; a slide cover 30 made of synthetic resin, and formed in a square-tube like manner, the slide cover 30 being slidably fitted in the hood portion 22 of the female connector housing 20; a rectangular male connector housing 40 made of synthetic resin, and the male connector housing 40 being supported in the slide cover 30 to be slidably movable reciprocally; and two lever 50 and 50 made of synthetic resin, the levers 50 and 50 being disposed between the slide cover 30 and the male connector housing 40 on both the respective sides of the slide cover 30 so as to be respectively directed in different directions. The male connector housing 40 on the movable side is fitted into the female connector housing 20 on the stationary side, or is detached from the female connector housing 20 due to the leverages of the levers 50 and 50 as the levers 50 and 50 are swung (pivoted) when the slide cover 30 is slidably moved reciprocally.

A rectangular openings 23 are formed in the left and right sides of the upper and lower walls 22*a*, 22*a*' of hood portion 22 of the female connector housing 20. Block-like projections 24 are projected from the respective front ends of the openings 23, and are integrally formed with the inner surfaces of the upper and lower walls 22*a*, 22*a*' of the hood portion 22. The back surfaces of the projections 24 and the front edge surfaces of the openings 23 serve as engaging surfaces 24*a*. Recessed portions 25 range from the front end to the back wall 21, and are formed on the respective inner-surface-one-sides of the upper and lower walls 22*a*, 22*a*' of the hood portion 22 of the female connector housing 20. Ribs 26 are projected from the respective back end of the recessed portions 25, and are integrally formed with the inner surface of the rear wall 21 facing the openings 23. Tapered surfaces (inclined surfaces) 26*b* are extended from the recessed portions 25 up to the centers of the ribs 26, respectively.

Figure 5A:
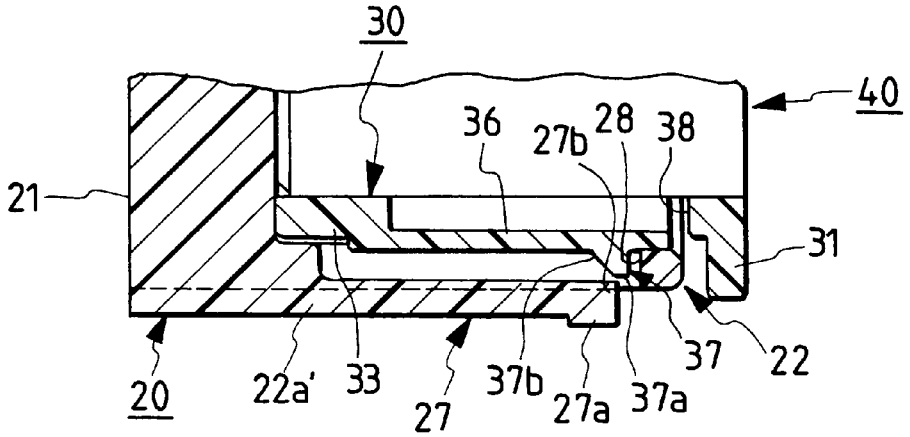
FIG. 5A is a sectional view of a locked condition after the female and male connector housings of the slidably fitting type connector are fitted to each other.

As shown in FIGS. 2, 5A, SB and 5C, a substantially L-shaped flexible unlocking arm 27 is integrally formed with the lower wall 22*a*' of the hood portion 22 of the female connector housing 20 to protrude from the center of the side wall 22*a*'. A U-shaped engaging hole 28 is formed at a periphery of the unlocking arm 27 excluding a coupling portion of the side wall 22*a*' of the base portion of the unlocking arm 27. A front end corner portion 27*b* is formed on the front side of the inner surface of a press portion 27*a*. The front end corner portion 27*b* is inwardly projected toward the engaging hole 28 by pressing the press portion 27*a* formed on the front side of the outer surface of the unlocking arm 27.

As shown in FIGS. 1 and 2, the slide cover 30 made of synthetic resin is formed in a rectangular-prism-tube-shape like manner. The slide cover 30 is slidable on the male connector housing 40, and also is slidable in the hood portion 22 of the female connector housing 20 when the female and male connector housings 20 and 40 are fitted to each other or are detached from each other. An annular collar-like operation portion 31 is integrally formed with and projected from the front end side of the outer peripheral surface of the slide cover 30. Further, long slits 32*a* and 33*a* and short slits 32*b* and 33*b* are respectively formed in both sides of the upper and lower walls 32, 33 of the slide cover 30. Furthermore, a pair of support shafts 34 and 34 are formed on opposed inner surfaces of each of the short slits 32*b* and 33*b*, and are integrally formed with the opposed inner surfaces of each of the short slits 32*b* and 33*b*. The support shafts 34 and 34 support base portions 51 and 51 of the levers 50 and 50 so that the levers 50 and 50 can pivotably move. On the other hand, the front end sides of the levers 50 can be inserted into and extracted from the long slits 32*a* and 33*a*.

Furthermore, a flexible arm 36 is formed in the center of the lower wall 33 of the slide cover 30, and is integrally formed with the lower wall 33. More specifically, the flexible arm 36 is formed in a thin-wall like manner, and is located in a U-shaped slit 38 formed in tho front side of the lower wall 33 of the slide cover 30 so that the flexible arm 36 is elastically deformable inwardly. A retaining portion 37 is protruded from the center of the flexible arm 36, and is integrally formed with the flexible arm 36. The retaining portion 37 has a trapezoidal shape in cross section. As shown in FIG. 2, a tapered surface 37*b* is formed at a rear side of the retaining portion 37. When the female and male connector housings 20 and 40 are fitted to each other, a flat surface 37*a* of the retaining portion 37 is normally brought into contact with or is adjacent to the front end corner portion 27*b* of the unlocking arm 27 so that the fitting condition of the female and male connector housings 20 and 40 can be retained by retaining (locking) the retaining portion 37 of the flexible arm 36 into the engaging hole 28. When the press portion 27*a* of the unlocking arm 27 is press-operated, the flat surface 37*a* of the retaining portion 37 is pressed by the front end corner portion 27*b* of the unlocking arm 27 to bend the flexible arm 36 inwardly and the front end corner portion 27*b* of the unlocking arm 27 is brought into contact with the tapered surface 37*b* of the retaining portion 37, whereby the retained condition (locked condition) of the retaining portion 37 of the flexible arm 36 in the engaging hole 28 at the side of the unlocking arm 27 is unlocked. In consequence, the slide cover 30 slightly sticks out with respect to the female connector housing 20 and the male connector housing 40 so that the slide cover 30 can be easily pulled out.

As shown in FIG. 2, the male connector housing 40 made of synthetic resin is formed in a substantially rectangular-shape like manner. The male connector housing 40 has a plurality of terminal receiving chambers 41 extending in the longitudinal direction. The respective terminal receiving chambers 41 receives female terminals (not shown) to be electrically connected to the male terminals 29 of the female connector housing 20 in order to electrically conduct both connector housings 20 and 40 when both connector housings 20 and 40 are fitted to each other. A wire harness (not shown) is also connected to each of the female terminal. Turning to FIG. 1, columnar support pins 42 and 42 are respectively formed to project as a points of action of the respective levers 50, and are integrally formed on the front sides of the respective side surfaces of the male connector housing 40.

Figure 4:
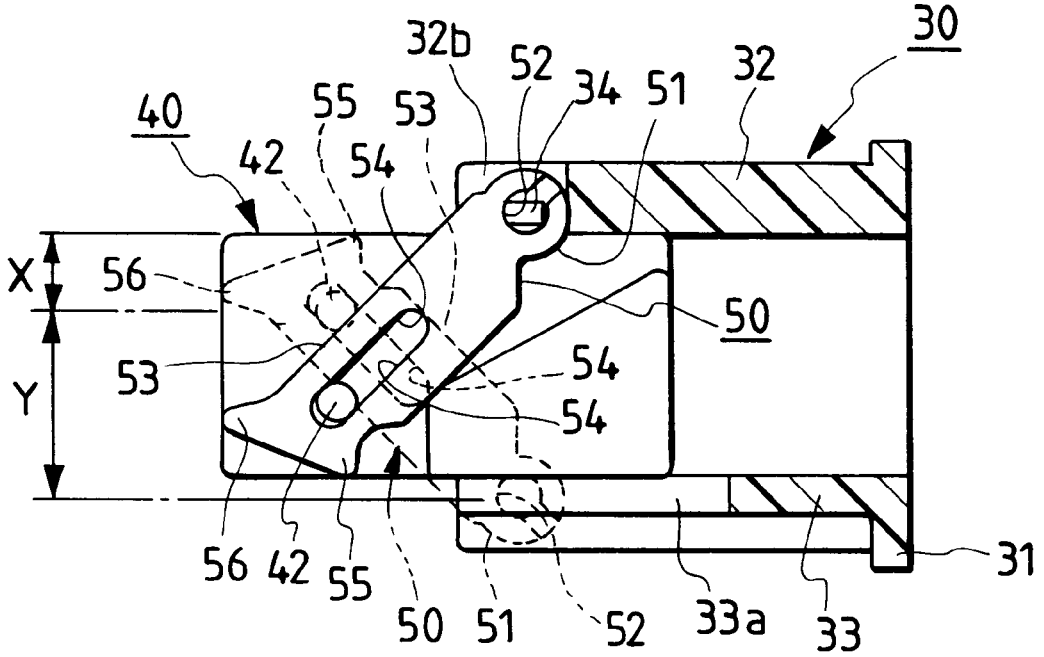
FIG. 4 illustrates a lengthwise relation between a point of action of the mule connector housing and a point of force application, and a lengthwise relation between a point of action of the male connector housing and a fulcrum of the lever movably supported with a slide cover overlying on the male connector housing.

Each of the levers 50 is made of synthetic resin, and is formed in a substantially rectangular-shape like manner. Substantially recessed pivotal support portions 52 are formed in the respective centers of the arcuate base portions 51 of the levers 50. The respective base portions 51 of the levers 50 are supported to be pivotally movable by fitting the support shafts 34 and 34 formed in the short slit 32*b* and 33*b* of the upper and lower walls 32 and 33 of the slide cover 30 into the pivotal support portion 52. Further, long holes 54 are respectively fixed in mid-portions 53 of the levers 50 as point-of-action receiving portions. The support pins 42 of the male connector housing 40 are slidably engaged with the long holes 54, respectively. A pair of leading end portions 55 and 56 are formed on the front end side of each of the levers 50, and respectively have a substantially triangular shape. The leading end portions 55 on the front sides of the levers 50 can be engaged with or disengaged from the projections 24 of the female connector housing 20 serving as first engaging portions. On the other hand, the leading end portions 56 on the back sides of the levers 50 can be engaged with or disengaged from the ribs 26 of the female connector housing 20 serving as second engaging portions. Further, as shown in FIG. 4, a distance Y from each of the base portions 51 of the levers 50 to each of the mid-portions 53 pivotally supported by the support pins 42 of the male connector housing 40 is longer than a distance X from each of the mid-portions 53 to each of the leading end portions 55 and 56.

Figure 3A:
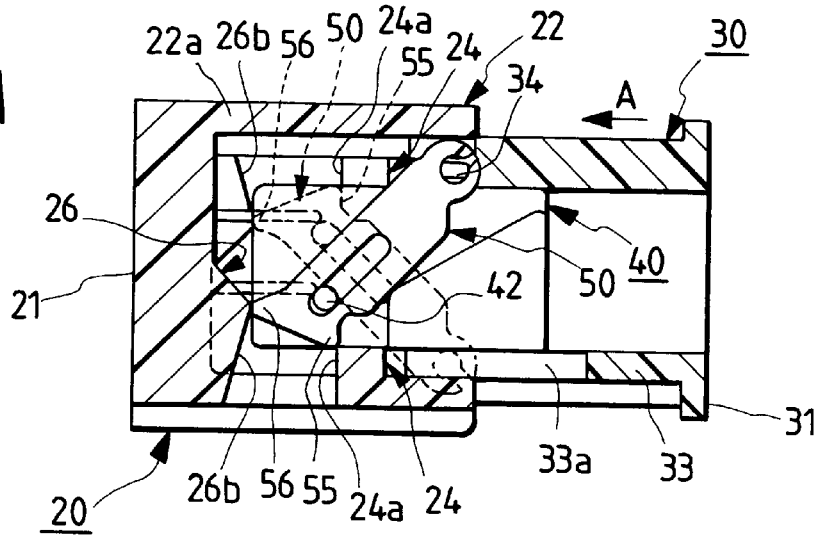
FIG. 3A is a sectional view showing a condition in that fitting of the male connector housing into the female connector housing is started.

According to the slidably fitting type connector 10 of the preferred embodiment of the present invention, the levers 50 are respectively inclined by the support shafts 34 of the slide cover 30 and the support pins 42 of the connector housing 40 before the female connector housing 20 and the male connector housings 40 are fitted to each other as shown in FIGS. 1 and 2. As shown in FIG. 3A, the leading end side of the slide cover 30 containing the male connector housing 40 is inserted to be temporarily fitted into the hood portion 22 of the female connector housing 20 on the stationary side. After that, the leading end portions 56 on the back sides of the respective levers 50 are respectively slid on and brought into contact with the tapered surfaces 26b of the ribs 26 formed in the hood portion 22 of the female connector housing 20, as the slide cover 30 is further pressed into the hood portion 22 in the fitting direction of both connector housings 20 and 40 (i.e., in the direction of an arrow A shown in FIG. 3A). That is, only the levers 50 are rotated by the initial forward movement of the slide cover 30. After that, the leading end portions 55 on the front sides of the levers 50 respectively enter in the openings 23 of the female connector housing 20 and upwardly project from the openings 23, and the leading end portions 55 on the front sides of the levers 50 are respectively brought into contact with the engaging surfaces 24*a* of the projections 24 so as to form fulcrums as shown in FIG. 3B.

Figure 3B:
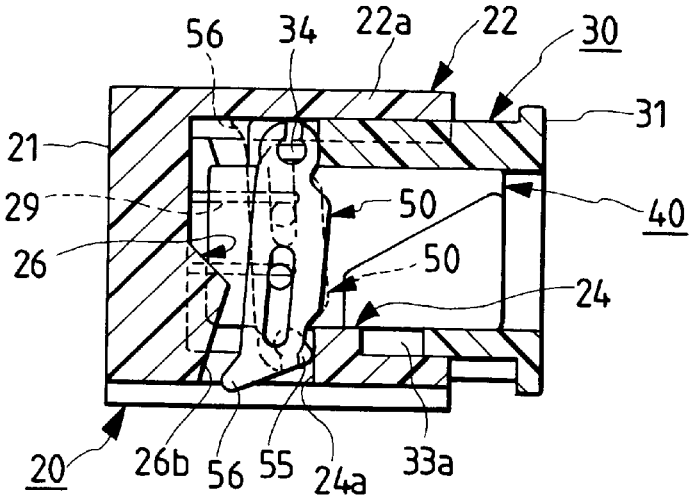
FIG. 3B is a sectional view showing a condition in that both housings are being fitted to each other.
Figure 3C:
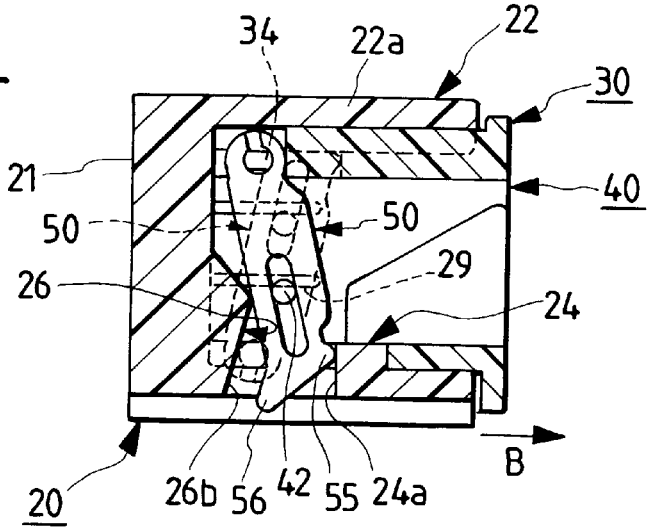
FIG. 3C is a sectional view showing a condition in that both housings are completely fitted to each other.

As shown in FIG. 3C, the male connector housing 40 is inserted into the hood portion 22 of the female connector housing 20 due to leverages of the levers 50 as the slide cover 30 is further pushed in the fitting direction from the state of FIG. 3B. In other wards, the male connector housing 40 is pushed into the hood portion 22 of the female connector housing 20 in accordance with the leverages in which the pivotal support portions 52 of the base portions 51 of the levers 50 serve as points of force application, the support pins 42 of the male connector housing 40 serve as points of action, and the leading end portions 55 on the front sides of the levers 50 serve as fulcrums. As a result, both connector housings 20 and 40 are fitted to each other. At the time of the fitting, the retaining portion 37 of the slide cover 30 is retained in the engaging hole 28 of the female connector housing 20 as shown in FIG. 5A, whereby the fitted condition of the both connector housings 20 and 40 is locked. Furthermore, the base portions 51 of the levers 50 are respectively guided by the recessed portions 25 of the female connector housing 20 until the retaining portion 37 of the slide cover 30 is locked in the engaging hole 28 of the female connector housing 20, whereby the slide cover 30 is smoothly and slidably moved without any play.

Figure 5B:
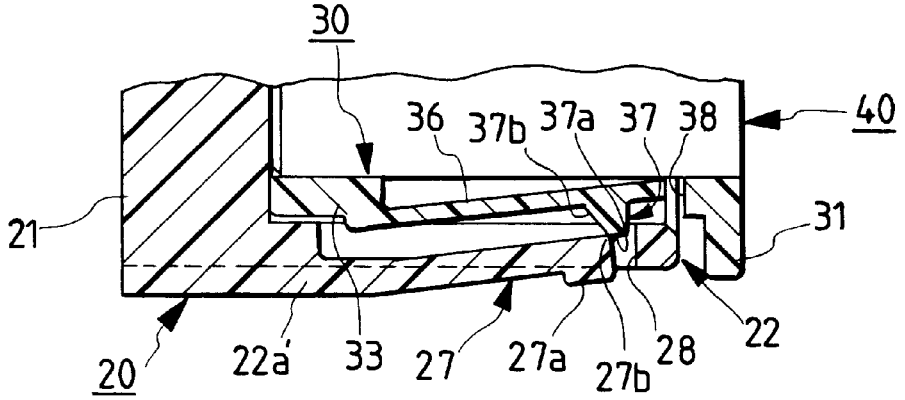
FIG. 5B is a sectional view while the locked condition is being canceled.
Figure 5C:
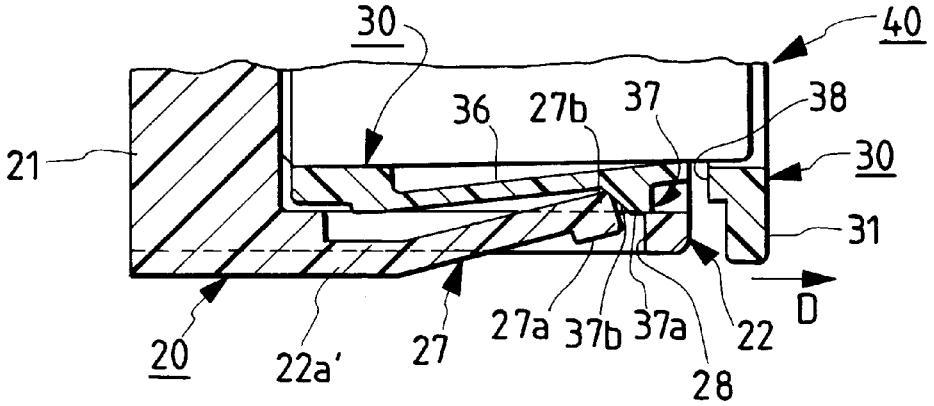
FIG. 5C is a sectional view when the locked condition is completely canceled.
Figure 6A:
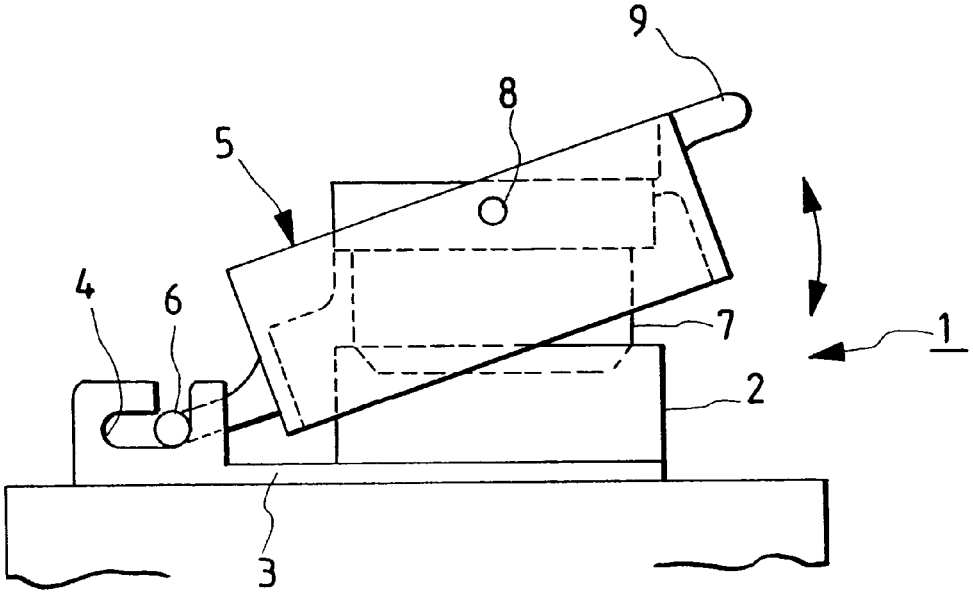
FIG. 6A PRIOR ART
FIG. 6A is a diagram illustrating a conventional lever type connector.
Figure 6B:
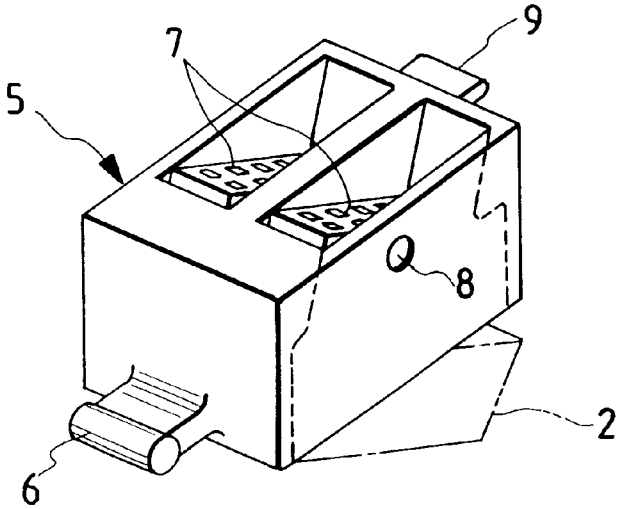
FIG. 6B PRIOR ART
FIG. 6B is a perspective view of the lever side of the lever type connector of FIG. 6A.

When the above fitted condition is released, the flat surface 37*a* of the retaining portion 37 of the slide cover 30 is prorrod by the front end corner portion 27*b* of the unlocking arm 27 as the unlocking arm 27 of the female connector housing 20 is pressed as shown in FIG. 5B, whereby the flexible arm 36 of the slide cover 30 is inwardly flexed and the front end corner portion 27*b* of the unlocking arm 27 abuts against the tapered surface 37*b* of the retaining portion 37. As shown in FIG. 5C, the locked condition of the retaining portion 37 of the flexible arm 36 and the engaging hole 28 on the unlocking arm 27 side is released, and the slide cover 30 is slightly pushed outwardly in a direction of an arrow D shown in FIG. 5C with respect to the female connector housing 20 and the male connector housing 40. Accordingly, the slide cover 30 can be easily pulled out as the slide cover 30 is pushed outwardly as shown in FIG. 5C. Both connector housings 20 and 40 are detached from each other due to the leverages of the levers 50 because the leading end portions 56 on the back sides of the levers 50 which abut against the tapered surfaces 26*b* of the ribs 26 serve as fulcrums as the slide cover 30 is pulled out. In other wards, both connector housings 20 and 40 are detached from each other in accordance with the leverages in that the pivotal support portions 52 of the base portions 51 of the levers 50 serve as points of force application, the support pins 42 of the male connector housing 40 serve as points of action, and the leading end portions 56 on the rear sides of the levers 50 serve as fulcrums when the slide cover 30 is pulled out in a direction of an arrow B shown in FIG. 3C.

Thus, the slide cover 30 is slidably movable in the fitting and detaching directions of the male and female connector housings. When the slide cover 30 is moved forwardly, the leading end portions 55 on the front side of the levers 50 are respectively abutted against the engaging surfaces 24*a* of the projections 24 of the female connector housing 20, and the male connector housing 40 is pulled into the female connector housing 20 so that both connector housings 20 and 40 are fitted to each other. When the slide cover 30 is moved backwardly, the leading end portions 56 on the back sides of the levers 50 are respectively abutted against the tapered surfaces 26*b* of the ribs 26 so that the connector housings 20 and 40 are detached from each other. Therefore, the fitting and detaching work of both connector housings 20 and 40 is easily achieved by merely sliding the slide cover 30 in the fitting and detaching directions of both connector housings 20 and 40 with a small operation force. In particular, since the fitting work of both connector housings 20 and 40 is easily achieved by merely pushing the slide cover 30 in the fitting direction, both connector housings 20 and 40 can be fitted to each other smoothly and quickly in a short time period without requiring skilled operation even if the fitting work is performed in a small mounting space where the female connector housing 20 on the stationary side is not precisely seen, for example.

Furthermore, since the levers 50 are contained in the slide cover 30 and never project outwardly from the slidably fitting type connector 10, the levers 50 are prevented from damage by external loading force. Accordingly, the function of leverages of the levers 50 (i.e., fitting function with a small operation force) never drop, and always both connector housings 20 and 40 are easily and surely fitted to each other. Particularly, since the levers 50 and 50 disposed between the slide cover 30 and the male connector housing 40 on both the respective sides of tho slide cover 30 ao as to be diagonally opposed to each other and since the distance Y from each of the base portions 51 of the levers 50 up to each of the mid-portions 53 inserting in and engaging with the support pins 42 of the male connector housing 40 is arranged so that the distance Y is longer than the distance X from each of the mid-portions 53 up to each of the leading end portions 55 and 56, the balance of forces acting on the respective support pins 42 as the point-of-action portions of the male connector housing 40 when both connector housings 20 and 40 are fitted to each other and separated from each other is stabilized by the two levers 50 and 50 set opposite in direction to each other. In consequence, both connector housings 20, 40 can be fitted to each other and separated from each other effectively and smoothly with the small operating force applied to the slide cover 30.

Furthermore, the length of each of the levers 50 can be shortened as much as possible and the whole connector can be made compact to this extent accordingly. Moreover, the leverages of the two levers 50 provided on both sides of the slide cover 30 is utilizable for easily and surely fitting and detaching multi-pole female and male connector housings 20 and 40. Thus, the number of parts and the manufacturing cost of the whole connector can be reduced.

Although the levers have been provided on inner both sides of the slide cover, an additional one may be provided in the center of the slide cover in order to increase the number of them to three or greater. Moreover, though the levers have been provided on the male connector housing side, such a lever may be provided on the female connector housing side.

According to the first aspect of the present invention, the multi-pole female and male connector housings can easily be fitted to each other and separated from each other by sliding the slide member in the fitting and detaching directions with the small operating force applied thereto by the leverages of the two levers interlocking with the slide member. Further, each lever is contained in the slide member and never sticks out of the slide member to ensure that the lever is prevented from being damaged by the external loading force and the like. Thus, the function of the leverages of the two levers are always not hampered to ensure that both connector housings are fitted to each other and separated from each other stably.

According to the second aspect of the present invention, the balance of forces acting on one of the connector housings when both connector housings are fitted to each other and separated from each other is stabilized by the two levers, so that both connector housings are effectively fitted to each other and separated from each other by sliding the slide member with smeller operating force.

What is claimed is:

1. A slidably fitting connector, comprising:

a first connector housing; p1 a second connector housing fittable to the first connector housing;

a slide member slidably movable on the second connector housing in fitted and detached directions of the second connector housing to and from the first connector housing, the slide member having at least two support shafts formed on at least inner opposite sides of the slide member between the slide member and the second connector housing; and at least two levers attachable to the support shafts, and pivotably supported by the support shafts, respectively, wherein the levers pivot as the slide member is slid on the second connector housing, and the levers are diagonally opposed to each other.

2. The slidably fitting connector of claim 1, wherein, the first connector housing has an engaging portion and an unlocking member, the slide member has a retaining portion engageable with and disengageable from the engaging portion, and wherein a fitted condition of the first and second connector housings is retained by an engagement of the retaining portion of the slide member and the engaging portion of the first connector housing, the engagement of the retaining portion and the engaging portion being released by pressing the unlocking member.

3. The slidably fitting connector of claim 2, wherein the retaining portion is formed on the slide member, the engaging portion is formed in the first connector housing, and the unlocking member is arranged on the first connector housing.

4. The slidably fitting connector of claim 1, wherein, the first connector housing has first engaging portions and second engaging portions formed therein;

the second connector housing has point-of-action portions formed thereon;

each of the levers includes:

a base portion pivotably supported by one of the support shafts, a mid-portion engaged with one of the point-of-action portions of the second connector housing, and a leading end portion engageable with and disengageable from each one of the first and second engaging portions of the first connector housing when the first and second connector housings are is fitted to each other and detached from each other.

5. The slidably fitting connector of claim 4, wherein when the slide member is slid in the fitting direction of the second connector housing, the leading end portions of the respective levers engage with the first engaging portions so that the first and second connector housings are pulled to each other.

6. The slidably fitting connector of claim 4, wherein when the slide member is slid in the detaching direction of the second connector housing, the leading end portions of the respective levers engage with the second engaging portions so that the first and second connector housings are pulled apart from each other.

7. The slidably fitting connector of claim 4, wherein, when the first and second connector housings are completely fitted to each other, the leading end portions of the levers are directed opposite to each other.

8. The slidably fitting connector of claim 1, wherein, the second connector housing has point-of-action portions formed thereon; and each of the levers includes:

a base portion pivotably supported by one of the support shafts, a mid-portion engaged with one of the point-of-action portions of the second connector housing, and a leading end portion engageable with and disengageable from the first connector housing when the first and second connector housings are fitted to each other and detached from each other.

9. The slidably fitting connector of claim 8, wherein a distance from the base portion to the mid-portion is set longer than a distance from the mid-portion to the leading end portion.

10. The slidably fitting connector of claim 1, wherein, when the first and second connector housing are completely fitted to each other, the levers are directed opposite to each other.

11. The slidably fitting connector of claim 10, wherein the levers are directed opposite to each other while sandwiching the second connector housing therebetween.

12. The slidably fitting connector of claim 1, wherein, when the first and second connector housings are disengaged from each other, the levers are diagonally opposed to each other while sandwiching the second connector housing therebetween.

13. The slidably fitting connector of claim 1, wherein, when the first and second connector housings are disengaged from each other, the levers are slanted in non-parallel directions with each other.

14. A slidably fitting connector, comprising:

a first connector housing;

a second connector housing fittable to the first connector housing;

a slide member slidably movable on the second connector housing in fitted and detached directions of the second connector housing to and from the first connector housing, the slide member having at least two support shafts formed on at least inner opposite sides of the slide member between the slide member and the second connector housing; and at least two levers attachable to the support shafts and pivotably supported by the support shafts, respectively, wherein the levers pivot as the slide member is slid on the second connector housing, and wherein, when the first and second connector housings are fitted to each other, the levers are diagonally opposed to each other.

15. The slidably fitting connector of claim 14, wherein, the first connector housing has an engaging portion and an unlocking member, the slide member has a retaining portion engageable with and disengageable from the engaging portion, and wherein a fitted condition of the first and second connector housings is retained by an engagement of the retaining portion of the slide member and the engaging portion of the first connector housing, the engagement of the retaining portion and the engaging portion being released by pressing the unlocking member.

16. The slidably fitting connector of claim 15, wherein the retaining portion is formed on the slide member, the engaging portion is formed in the first connector housing, and the unlocking member is arranged on the first connector housing.

17. The slidably fitting connector of claim 14, wherein, the first connector housing has first engaging portions and second engaging portions formed therein;

the second connector housing has point-of-action portions formed thereon;

each of the levers includes:

a base portion pivotably supported by one of the support shafts, a mid-portion engaged with one of the point-of-action portions of the second connector housing, and a leading end portion engageable with and disengageable from each one of the first and second engaging portions of the first connector housing when the first and second connector housings are fitted to each other and detached from each other.

18. The slidably fitting connector of claim 17, wherein, when the slide member is slid in the fitting direction of the second connector housing, the leading end portions of the respective levers engage with the first engaging portions so that the first and second connector housings are pulled to each other.

19. The slidably fitting connector of claim 17, wherein, when the slide member is slid in the detaching direction of the second connector housing, the leading end portions of the respective levers engage with the second engaging portions so that the first and second connector housings are pulled apart from each other.

20. The slidably fitting connector of claim 17, wherein, when the first and second connector housings are fitted to each other, the leading end portions of the levers are directed opposite to each other.

21. The slidably fitting connector of claim 14, wherein, the second connector housing has point-of-action portions formed thereon; and each of the levers includes:

a base portion pivotably supported by one of the support shafts, a mid-portion engaged with one of the point-of-action portions of the second connector housing, and a leading end portion engageable with and disengageable from the first connector housing when the first and second connector housings are fitted to each other and detached from each other.

22. The slidably fitting connector of claim 21, wherein a distance from the base portion to the mid-portion is set longer than a distance from the mid-portion to the leading end portion.

23. The slidably fitting connector of claim 14, wherein the levers are directed opposite to each other while sandwiching the second connector housing therebetween.

24. The slidably fitting connector of claim 14, wherein, when the first and second connector housings are disengaged from each other, the levers are slanted in non-parallel directions with each other.

* * * * *

UNITED STATES PATENT AND TRADEMARK OFFICE

CERTIFICATE OF CORRECTION

PATENT NO. : 5,975,929

DATED : November 2, 1999

INVENTOR(S) : MATSUURA et al.

It is certified that error appears in the above-identified patent and that said Letters Patent is hereby corrected as shown below:

Column 8, Line 15 delete ``p1''.

Column 8, Line 61 delete ``is''.

Signed and Sealed this

Seventh Day of November, 2000

*Attest:*

Q. TODD DICKINSON

*Attesting Officer*

*Director of Patents and Trademarks*